United States Patent [19]

Dubé et al.

[11] Patent Number: 4,832,911

[45] Date of Patent: May 23, 1989

[54] METHOD OF ALLOYING ALUMINIUM

[75] Inventors: Ghyslain Dubé, Jonquiere; Bruno Gariépy, Chicoutimi; Jean Paré, La Baie, all of Canada

[73] Assignee: Alcan International Limited, Montreal, Canada

[21] Appl. No.: 97,792

[22] Filed: Sep. 16, 1987

[30] Foreign Application Priority Data

Sep. 18, 1986 [GB] United Kingdom ..... 8622458

[51] Int. Cl.[4] ..... C22C 21/00

[52] U.S. Cl. ..... 420/528; 420/590

[58] Field of Search ..... 420/590, 528

[56] References Cited

U.S. PATENT DOCUMENTS

| | | | |
|---|---|---|---|
| 2,595,292 | 5/1952 | Reece | 420/590 |
| 3,592,637 | 7/1971 | Brown et al. | 420/528 |
| 3,788,839 | 1/1974 | Faunce | 420/528 |
| 4,080,200 | 3/1978 | Sheridan | 420/528 |
| 4,174,965 | 10/1979 | Buxmann | 420/590 |
| 4,248,630 | 2/1981 | Balmuth | 420/528 |
| 4,383,970 | 5/1983 | Komuro et al. | 420/548 |
| 4,556,535 | 12/1985 | Bowman et al. | 420/528 |

FOREIGN PATENT DOCUMENTS

| | | | |
|---|---|---|---|
| 2171117 | 8/1986 | United Kingdom | 420/590 |

*Primary Examiner*—Upendra Roy
*Assistant Examiner*—David Schumaker
*Attorney, Agent, or Firm*—Cooper & Dunham

[57] ABSTRACT

Aluminium is alloyed by adding alloying ingredients to the molten metal in an intermediate treatment vessel or ladle rather than as at present in a casting furnace. If several ladles are used to supply the casting furnace, the alloying ingredients may be added to some but not all of them. A preferred order of addition of alloying ingredients is: (i) $AlF_3$ to reduce unwanted Na, Ca and Li; (ii) one or more of Mn, Fe, Cr, Ni, Cu, Zn and Si in powder form; (iii) one or more of Zn, Cu and Si in massive form; (iv) Mg. A ladle/impeller design is described.

15 Claims, 2 Drawing Sheets

METHOD OF ALLOYING ALUMINIUM

Figure 1:
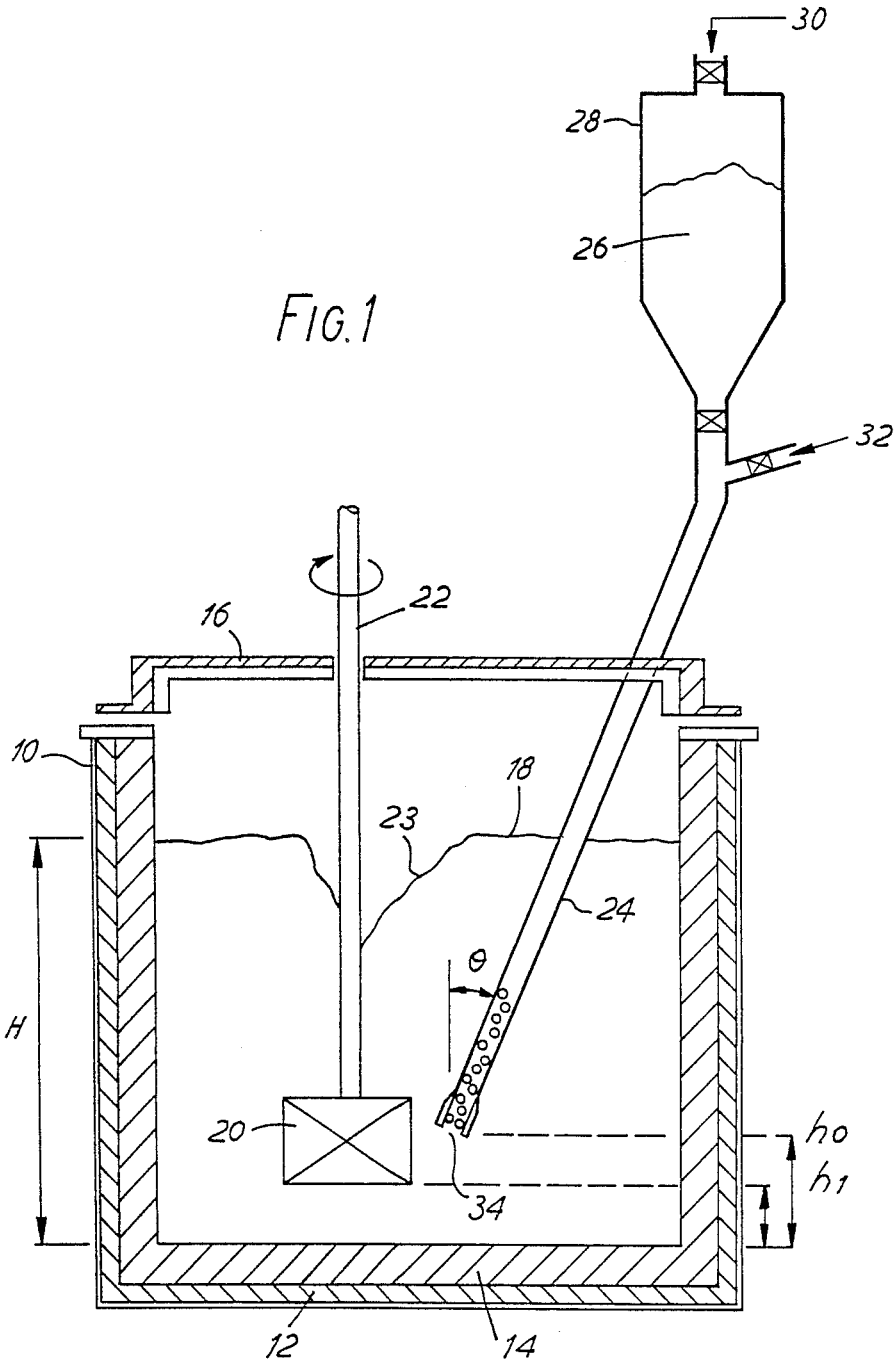

In the aluminium industry today, molten aluminium produced in Hall-Heroult reduction cells is generally transferred into reverberatory furnaces prior to casting. Various operations take place in these furnaces in order to carry out the alloying and refining of the molten aluminium. General practices include additions of alloying elements in various forms (ingots, granules, briquettes, powder), stirring, heating, fluxing and settling. Although many operations are carried out in these reverberatory furnaces, their design has been almost entirely dictated by casting requirements of aluminium and aluminium alloys. Because of its very strong affinity for oxygen, aluminium and Al alloys are generally cast in so-called "level pour" operation. This implies that molten Al level from furnace to casting machines is kept as constant as possible in order to avoid turbulence or cascading. Temperature homogeneity in reverberatory furnaces also dictates that metal depth be minimized in order to reduce temperature gradients from the superheated surface to the colder bottom of the metal pad. Finally, the increasing size of the casting furnaces to feed bigger casting machines makes the operations carried out less and less effective.

One can classify actual metallurgical operations in furnaces in four categories:

(1) Alloying element additions
(2) Stirring of the melt for
  (a) Dissolution of alloying element and chemical composition homogenization
  (b) Temperature homogenization
(3) Melt fluxing
(4) Solid inclusion sedimentation by settling.

(1) ADDITIONS OF ALLOYING ELEMENTS

The preparation of aluminium alloys necessitates the addition of substantial quantities of Mg, Mn, Fe, Si, Cu, Cr, Zn and others to the primary aluminium produced in reduction cells. Raw materials used for alloying purposes appear in various forms like ingots, master alloys, chunks, granules, flakes, briquettes and powders.

Two important characteristics of the alloying element have dictated the ways and means of alloying practices over the years.

(a) Melting Points

Most of alloying elements have melting points substantially higher than Al, for example:

| Element | Melting Pt ° C. |
|---|---|
| Mn | 1244° C. |
| Fe | 1535° C. |
| Cr | 1875° C. |
| Cu | 1083° C. |
| Si | 1410° C. |
| Al | 660° C. |

Dissolution of these elements is therefore driven by a slow solid-liquid diffusion process rather than melting and liquid-liquid diffusion which is more rapid.

On the other hand Mg and Zn have lower melting points than A1 (651° and 419.5° C. respectively).

(b) Buoyancy

All alloying elements except Mg are non-buoyant in Al melts. Diffusion and therefore dissolution in Al melts is delayed if additions are not fully dispersed. Molten metal must also be continuously stirred to rejuvenate the solid liquid interface.

Moreover, melt temperatures in reverberatory furnaces are generally maintained below 780° which further limits the dissolution rates of alloying elements.

In order to achieve rapid and reliable dissolution of high melting point and non-buoyant elements (Mn, Cr, Fe, Cu, etc.) various methods have been used or proposed over the years.

Master alloys, consisting of premelted solution provided fairly rapid solution rate and reliable recoveries. However, according to actual practices, this technique requires either separate alloying furnaces or remelting when the supply is not on location.

It has been proposed as in Canadian Patent No. 1153209 to use ferro alloys (Fe-Mn, Fe-Si, Fe-Cr, etc.) instead of pure metal in master alloys to reduce the cost of production of the desired aluminium alloy. The use of master alloys have gradually been replaced mainly because of cost considerations and also because of the diversity and complexity of aluminium alloys produced today.

Briquettes or tablets consisting of compressed mixtures of metal and aluminium powders (about 25% Al) have generally replaced master alloys. They dissolve fairly rapidly, and are more convenient to use and in most uses are cheaper than master alloys. Again, processing costs and contained Al add to the cost of alloying by this method.

Improvements to the use of briquettes have been proposed as described in UK Patent Application No. 2112020 and Canadian Pat. No. 1153209 but they have not found industrial acceptance. An additional drawback to the use of briquettes is that good melt stirring remains essential for rapid dissolution rate. As discussed below, melt stirring practices in reverberatory furnaces are often not effective enough to take full benefit of the use of briquettes.

Direct injection of metal powders in Al melts is rapidly replacing previous techniques as it offers favorable cost advantages and dissolution rates. Apelian, D. et al (TMS paper selection A-79-37) investigated the parameters which govern direct injection of metal powders in particular Mn powders. Results of this investigation as well as industrial observations show that:

Injection velocities must be high for smaller particles ($\leqq 100\ \mu m$) to penetrate the Al melt. A carrier gas ($N_2$, Ar) is used to carry the material and also to provide the necessary melt stirring. This technique creates enormous surface turbulence and therefore generates substantial metal loss due to oxidation. Even when fine powders (40 to 500 microns) are used, it is not unusual for industrial practices to call for a 20 to 30 min. stirring after powder injection in reverberatory furnaces.

Lack of recovery is often associated with finer particles.

Under certain conditions, a clinker may form which further delays the dissolution process.

The case of Mg addition is quite unique. Indeed Mg not only is buoyant in Al melt but also melts at operating temperatures. Additionally Mg readily oxidizes or burns and has a tendency to react with floating skim or slag. Actual operating practices of Mg addition are the cause of three serious problems:

Addition of magnesium yields a recovery of only about 90%. This 10% lost implies an important additional cost given the sizable amount of Mg used in the aluminium industry today.

Upon oxidation, magnesium form solid inclusions like MgO and $MgAl_2O_4$ which disperse in the aluminium melt. Although small in size (less than 100 μm) these inclusions are very detrimental to subsequent processing and metal forming operations. For example, it is estimated that 50,000 particles/kgAl are present in beverage can alloys fed from casting furnace. Stringent requirements on metal cleanliness of such products demand costly treatment and filtration operation to be carried out in specific units between furnaces and casting machines.

Upon stirring in furnaces as it is performed today, the skim or slag on the melt surface is thoroughly mixed with the Al-Mg alloy. The slag generally contains some proportion of electrolyte from the pot tapping operation. Various compounds (NaF, $CaF_2$) in the electrolyte are then free to react with magnesium in the alloy as follows, the sodium content of the alloy being determined by the reaction:

$$\underset{\text{(solid)}}{2NaF} + \underset{\text{(solution)}}{Mg} \rightleftharpoons \underset{\text{(solid)}}{MgF_2} + \underset{\text{(solution)}}{2Na}$$

Alkali contaminants must be removed prior to casting, again adding to the cost of melt preparation.

(2) STIRRING

As mentioned above, stirring of the furnace melt is a lengthy and rather inefficient operation because of the geometry of the metal pad and because of ineffective alloying practices. Stirring methods generally fall into two categories:

(a) Mechanical methods using large rakes mounted on fork lift trucks moving back and forth and sideways to provide the necessary metal motion.

(b) Pneumatic methods whereby pressurized high velocity gas ($N_2$) is injected with lances to provide stirring motions.

In both cases, the strong surface turbulence generates substantial amount of metal loss as the protective aluminium oxide skin is continuously broken and reformed.

Submerged metal pumps have been developed to improve stirring methods but have found only marginal acceptance because of cost considerations and material/maintenance problems. Actual stirring methods are also associated with substantial amount of heat losses. Reheat of the melt is therefore often necessary which further delays the batch preparation.

(3) and (4) FLUXING AND SETTLING

The direct consequence of non effective methods used for alloying and stirring of Al melt in reverberatory furnaces is a number of additional operations that have to be carried out in order to bring the melt back to specified requirements prior to casting. These operations are aimed at removing dissolved contaminants such as alkali (Li, Na, Ca) and hydrogen and solid inclusions such as MgO, $MgAl_2O_4$, $Al_4C_3$, $Al_2O_3$, MnO, etc. Fluxing the Al melt with gas mixture of $N_2$/Ar-$Cl_2$ is a widespread practice in the industry today. Gas bubbling is used to lower the hydrogen content in solution in aluminium and Al alloys. It also contributes to the removal of alkali elements and inclusions when chlorine is a part of the gas mixture. A settling period is also included in the practice to allow for the inclusions to sediment. However, as for alloying and stirring, these operations were found insufficient to meet requirements of numerous products. Therefore the whole aluminium industry has adopted in-line treatment units such as described in U.S. Pat. Nos. 3,839,029; 3,743,263; 4,426,068; 4,177,065 and 4,177,066 in order to refine and clean molten aluminium prior to casting. Despite the effectiveness of this approach, it is a costly solution to furnace malpractices and furthermore does not propose any solution at the source of the problem.

DESCRIPTION OF THE INVENTION

It is an object of this invention to provide methods and means to prepare and refine aluminium alloys in treatment vessels before metal transfer into reverberatory furnaces.

In normal aluminium smelting-casting operations, primary Al from cell is syphoned into ladles for transport to the casting area. Molten aluminium in reduction cells is maintained at temperatures of about 950° C. to 960° C. After transfer to ladles, it is transported rapidly to the casting area. It is another object of this invention to perform alloying and refining operations in these ladles.

Over the years, the development and industrial implementation of processes described in EPA No. 65854, published Dec. 1, 1982, for the removal of alkali elements in aluminium has proven the effectiveness of treatment of aluminium in potroom crucibles.

This invention provides a method of making a cast ingot of aluminium alloyed with one or more alloying components, by the steps of making molten aluminium in a production vessel, passing molten metal from the production vessel to a treatment vessel, passing molten metal from the treatment vessel to a casting vessel, and casting an aluminium alloy ingot from the casting vessel, characterized in that at least one alloying component is added and dissolved in the molten metal in the treatment vessel.

The nature of the production vessel is not critical. This may be simply a furnace for melting solid aluminium from any source. But usually the production vessel is an electrolytic reduction cell or a series of such cells constituting a potline.

The nature of the treatment vessel is also not critical. This is usually a transfer vessel, a potroom crucible or a ladle in which molten metal is transferred from a reduction cell to a casting furnace. Alternatively it may be a stationary vessel to and from which molten metal is transferred. The treatment vessel may be insulated, or even heated, although this latter expedient is not usually necessary when the molten metal comes from a reduction cell. The treatment vessel is preferably open at the top, which is simple and cheap and permits alloying additions to be made to the interior of a vortex in the molten metal surface generated by an impeller as described below. Provided turbulence is controlled, the use of an inert gas atmosphere or vacuum is not necessary.

The casting vessel is most usually a casting furnace such as a reverberatory furnace. Exceptionally, however, it may be preferred to cast the alloy direct from a ladle or other treatment vessel, e.g. when the cast bodies are intended for subsequent remelting.

The invention also contemplates the use of other vessels intermediate the production vessel and the casting vessel. For example, some smelters use a holding furnace between the reduction cells and the casting furnace, with molten metal transfer by means of ladles and/or via a trough.

In normal Al smelting-casting operations, reverberatory casting furnaces are filled directly with molten aluminium from potrooms and with a small proportion of solid returns or primary aluminium. In most cases, it takes the content of several crucibles to make the furnace charge. These crucibles may carry from 2 to 10 tons of metal. Because of their geometry and because of the high metal temperature (830°-900° C.) during the transfer stage, such containers are ideal for metallurgical operations such as alloying. For instance, the ratio of height/diameter (H/D) of metal in a ladle typically lies between about 0.4 and 1.0 while the furnace ratios are generally about 0.1-0.15. (Furnaces being rectangular rather than circular, the value of D is calculated as the mean between the length and width of furnace chamber.) Moreover molten metal temperature is from 50° to 100° C. higher in crucibles than in reverberatory furnaces. According to the invention, molten metal arriving from potrooms may or may not be transferred into a designated metallurgical ladle. In practice however, it is recommended to transfer molten Al from potroom crucibles into a specific ladle for various reasons.

(i) Potroom crucibles always contain more or less electrolyte entrained during syphoning of the reduction cells. When subsequent alloying with Mg takes place, this electrolyte reacts with dissolved Mg according to the equations:

$$Mg+2NaF \rightleftharpoons MgF_2+2Na$$

$$Mg+2LiF \rightleftharpoons MgF_2+2Li$$

$$Mg+CaF_2 \rightleftharpoons MgF_2+Ca$$

These reactions further contaminate the molten aluminium in a way that is not reversible with an addition of $AlF_3$ in crucible as described in EPA No. 65854.

Molten metal may be transferred by syphoning or by direct pouring into the treatment ladle. At that stage, molten aluminium stands at about 850° to 900° C. At these temperatures, the electrolyte has already started to solidify and therefore remains in the potroom crucible. In practice, only a small proportion (less than 10%) of the electrolyte may be transferred into the treatment ladle by a direct pouring method.

(ii) In most cases, potroom crucibles used for molten metal transport are not insulated thus losing heat fairly rapidly. In order to carry the alloying at highest possible temperature, it becomes advantageous to use a well insulated ladle in which subsequent operations will be performed.

Under these conditions, molten aluminium will remain at sufficiently high temperature and for a period of time to allow for alloying and refining in the ladle without any external heat input. This becomes specially important with additions with endothermic dissolution such as magnesium, copper and silicon are made.

(iii) The use of specific ladles for alloying and refining of primary aluminium also becomes advantageous when two or more alloys are prepared simultaneously. The risk of alloy contamination is minimized when preparation ladles are used for each alloy.

In addition to metal temperature and appropriate reaction vessel (ladle) geometry, good stirring of the melt and methods and means of addition are important for achieving full (100% ) and rapid dissolution.

In EPA No. 65854, there is described a method for removal of Li and other alkali and alkaline earth metals from molten aluminium in which a strong circulation within the body of molten metal, for example a potroom crucible, is created by means of a rotating impeller. Although not limited by this particular method of molten metal stirring, it will be seen that the method of the present invention is very conveniently carried out in conjunction with the treatment of molten aluminium as described in EPA No. 65854.

During development of this invention, methods and means of alloy additions had to be optimized to achieve complete (100%) reliability and rapid (less than 15 min) dissolution of the elements. These methods varied according to the type, the chemical properties and the physical characteristics of the alloying element used.

(1) Higher melting point than Al

Elements such as Mn, Fe, Cr, Ni, Cu, Si fall into that category.

Within that category, elements can be subdivided as having a slow dissolution rate or a rapid dissolution rate in molten aluminium.

(a) Slow dissolution

Manganese and iron are used extensively as alloying elements and fall into this category. Cr and Ni, although used in lesser extent, also fall into this category.

Manganese, iron, chromium and other alloying elements of the same category should be added to the body of molten Al in ladles in the form of fine powders. Powder size distribution should preferably be within minus 35 mesh (<420 microns) and plus 325 mesh (>44 microns) for rapid dissolution and full recoveries. It is recommended to use metal powders having less than 10% on each of the >420 micron and <44 micron fraction. Accordingly, it is not recommended to use briquettes or flakes as feed material in order to achieve reasonable dissolution time. For instance electrolytic Mn flakes showed dissolution time 3 to 4 times longer than Mn powder for addition of up to 3%. An impeller can provide sufficiently good stirring to carry the dissolution process in ladles. However, it was found that the process of alloying with Mn and Fe for instance could be improved by lowering the impeller close to the bottom of the ladle and/or by using unpitched blades. This modification has the effect of increasing the agitation of the metal at the bottom of the ladle where non-buoyant particles tend to accumulate.

Metal powders such as Mn, Fe and Cr powders are best added to the body of molten Al by subsurface injection using an inert carrier gas ($N_2$, Ar). Contrary to actual injection practices characterized by high carrier gas velocity and strong surface turbulence, it is recommended to carry the feed material with minimum gas consumption.

In order to prevent losses associated with flotation and oxidation of fine powders, it is recommended to position the injection lance at an inclined angle to the vertical. It is also recommended to locate the opening of the lance in a position such that metal powders are entrained downwardly and radially by the flow of molten metal. Maximum dispersion of the particles is thus achieved with minimum chance of clinker formation. In addition the carrier gas bubbles exiting the lance are entrained in an upward radial motion terminating in the vortex formed by molten metal in motion. Upon breaking at the metal-air interface, the bubbles release the fine metal particles that may have been carried along. These particles are then immediately drawn into the body of molten Al by the action of the vortex. This procedure prevents surface oxidation of metal powders often associated with injection at high carrier velocity.

The addition of metal powders namely Mn, Fe, Cr, and Ni made according to the terms of this invention is characterized by a very rapid dissolution time. Additions of up to 4% Mn and 1.5% Fe dissolved completely in less than 8 minutes. Because of the effectiveness of the process and the exothermic dissolution of these elements, the process is characterized by a rapid increase in temperature of the molten metal body as high as 9° to 10° per 1% of additions. Thus, according to this invention, a full furnace batch can be prepared by alloying in only a fraction of the ladles making the furnace charge. The maximum additions of alloying elements are such that, according to the various phase diagrams, no intermetallic compounds are allowed for form and to precipitate at the bottom of the ladle.

Addition of metal powders into the vortex as described for $AlF_3$ additions in EPA No. 65854 could also be made. However this method was less reliable, yielded some losses by oxidation and therefore generated detrimental solid inclusions in Al.

Moreover, safety hazards related to explosivity and toxicity of metal powder can exist if vortex additions are used.

Other methods have been proposed to add powdered material to molten metal without the use of high velocity carrier gas. Such a method is described in U.S. Pat. No. 4,109,898. It has several drawbacks however compared to the method proposed here, namely Moving parts with gas seals Protective coating Erosion of the slinging nozzle.

Copper Additions

Regarding copper additions to aluminium, the combined effect of high metal temperature (>800° C.) ladle geometry and melt stirring permit the use of solid copper pieces. Bar slices (20 kg ea.) and 8 kg ingots in additions of up to 1% completely dissolved in less than 5 minutes when added into ladles. Additions of Cu pieces can be made equally before or during stirring of the melt in ladles. It becomes evident that the application of methods for alloying in ladles described above for Cu as well of Mn, Fe, Cr and Ni represent substantial saving over master alloys or briquettes. Actually, master alloys are not recommended and may indeed be not compatible with the methods of the invention since their aluminium content could result in excessive temperature losses.

(b) High melting point/rapid dissolution

Silicon is the main alloying element of this category. It should be added as pure metallic silicon during stirring of the melt as discussed previously. Since silicon dissolves rapidly in ladles, raw materials in the form of fairly large chunks (10-20 cm) or powders (90% >44 microns) can equally be used.

(2) Lower melting point than Al

Zinc is non-buoyant in Al, and may be added in either powder or massive form. The solution of zinc in aluminium is endothermic.

Magnesium is the only alloying element which is buoyant in Al, but because of its importance in aluminium alloys and because of its special characteristics, particular methods of addition must be applied.

While alloying aluminium with magnesium in ladle or furnace, it is important not to put molten Al-Mg alloy in contact with residual electrolyte. In order to prevent further contamination in Na, Ca and Li, it is recommended to transfer molten metal from potroom crucible into a designated process ladle.

As discussed above, metal transfer must ensure that electrolyte is not carried in any extent into the process ladel.

In order to achieve rapid dissolution and residual alkali (Na, Ca, Li) content lower than 5 ppm following the $AlF_3$ addition, Mg additions should be carried out under certain conditions. First, it is desirable to avoid vortexing of the molten metal body. In effect, vortex flow pattern will draw surface floating electrolyte into the bulk of the molten metal body therefore favouring the exchange between magnesium and the various fluoride compounds.

Vortexing may be prevented by reducing the speed of a rotating impeller (60–100 RPM vs 150 RPM) and/or by positioning the impeller off ladle centre. Minimum off centre position is obtained when the impeller blade tip is tangent to the ladle symetrical axis. Magnesium ingots (up to 23 kg) can be used as raw material. Pure Mg ingots are the cheapest source of Mg and their unit size is small enough to achieve tight specification accurately. Since solid Mg is buoyant in Al, Mg ingots float on the melt surface. As they melt, liquid Mg is instantaneously drawn and dissolved into the bulk of the molten Al body. Dissolution time is less than 5 minutes even for large Mg additions (up to 10%).

Since these conditions are maintained to prevent contamination by alkali back reaction, Mg additions are preferably carried out last in the overall process. A preferred sequence of additions to the ladle can now be established to achieve maximum effectiveness. First, the addition of $AlF_3$ (optional) for removal of alkali and alkaline earth elements. Second, addition of alloying elements have an exothermic dissolution in Al namely, Fe, Mn, Cr, and Ni. Simultaneously or immediately after, follow additions of Cu, Si which have endothermic reaction but are normally added in smaller amounts. Dissolution parameters of Cu and Si are also identical to those of Fe, Mn, etc. as far as impeller speed and position are concerned.

Having reached maximum temperature and almost complete dissolution of the former elements, impeller speed and position for non vortex conditions are set and Mg additions made. Maximum Mg addition is determined according to phase diagrams and also on the basis of metal temperature in ladles. Indeed, in some cases, Mg additions may have to be limited in order prevent freezing as Mg additions are associated with a temperature loss of about 8°–10° C. per percent added in a non-heated insulated ladle.

Magnesium additions in ladles have been shown to yield recoveries of 98%–100% as opposed to about 90% for conventional operations in furnaces. In addition to raw material saving, the method of this invention provides substantial improvement in metal cleanliness. Only limited quantities of inclusions form by oxidation during alloying and indeed these can be collected within the ladle by the action of the flux. This collection mechanism has earlier been described in EPA No. 112024.

Improvement in metal cleanliness by application of ladle metallurgy can provide savings in time and cost of furnace and in-line treatment operations. Since clean and alloyed metal is delivered to furnaces, fluxing and settling in furnaces can be eliminated or greatly reduced for the same cast metal quality. Alternatively, if furnace and in-line operation are maintained, the method of the invention can provide better and cleaner metal to casting machines than otherwise possible.

It finally comes out as a preferred feature of the invention that, because of the rapidity and effectiveness of the process, the alloying and refining of primary aluminium can be made in ladles during the transfer operation from potrooms to casting furnaces without any external heat input. (Of course, external heat can be supplied if it is required.) Because of its effectiveness too, the total alloying requirement for a full furnace can be added into a fraction of the ladles to make a given charge. Liquid master alloys of various compositions and concentrations are then produced to match the immediate alloy production without need for solidification, inventory and remelting. Table 1 provides some examples of how the method can be applied to production of various alloys. It is assumed that each ladle holds 5 tons, so that eight ladles are required to make up a metal charge of 40 tons. The alloying additions take into account the Fe and Si content of primary Al.

TABLE 1

| | Alloy Specification (%) | | | | | | Alloying additions (Kg) | | | | | | Total addition for furnace |
|---|---|---|---|---|---|---|---|---|---|---|---|---|---|
| Alloy | Cu | Fe | Mg | Mn | Si | Cr | Cu | Fe | Mg | Mn | Si | Cr | (Kg) |
| AA-1100 | 0.075 | 0.55 | — | — | 0.15 | — | 30 | 180 | — | — | 40 | — | 250 kg |
| AA-3003 | 0.075 | 0.61 | — | 1.08 | 0.22 | — | 30 | 204 | — | 432 | 68 | — | 734 kg |
| AA-3004B | 0.16 | 0.44 | 1.05 | 1.10 | 0.20 | — | 64 | 136 | 420 | 440 | 60 | — | 1120 kg |
| AA-5052 | — | 0.25 | 2.5 | — | — | 0.2% | — | 60 | 1000 | — | — | 80 | 1140 kg |
| AA-5182 | — | 0.25 | 4.5 | 0.35 | — | — | — | 60 | 1800 | — | — | — | 2000 kg |

As shown in table 1, a wide variety of alloys and concentration can be produced in ladles depending on the specific production requirements. The concentration ratio (ratio of alloying concentration in a ladle over concentration of the alloy to be produced) for example can vary from as high as 20:1 for almost pure aluminium up to a ratio of 1:1 for highly alloyed products. The amount of alloying additions to a ladle depends on the solubility of the elements in aluminium alloys at operating temperature. The maximum additions for the various elements is defined as being the concentration at which intermetallic compounds start to precipitate in the liquid metal. In practice, temperature losses due to endothermic dissolution of Mg, Si and Cu for example will also impact on the maximum amount of additions in ladles. Aluminium content in alloy or master alloy produced in ladles should therefore be at least 75%.

According to the terms of this invention, an aluminium casting furnace is filled with a certain number of crucibles of primary aluminium from reduction cells. Alloying requirements for the furnace batch are added directly into process ladles following the method described above. Upon completion of the furnace charge, the melt need only to be homogenized in temperature and composition and if required limited fluxing to extend removal of alkalis and/or settling period for metal cleanliness improvement. Total time for operations in furnaces can be limited to 30 to 60 min. with ladle alloying and refining without delaying the charge make-up. In conventional aluminium casting practices, alloy preparation time in furnaces can be of some hours. Cost reduction and/or increase in production capacity can be anticipated from implementation of the methods and means described in this invention.

Figure 2:
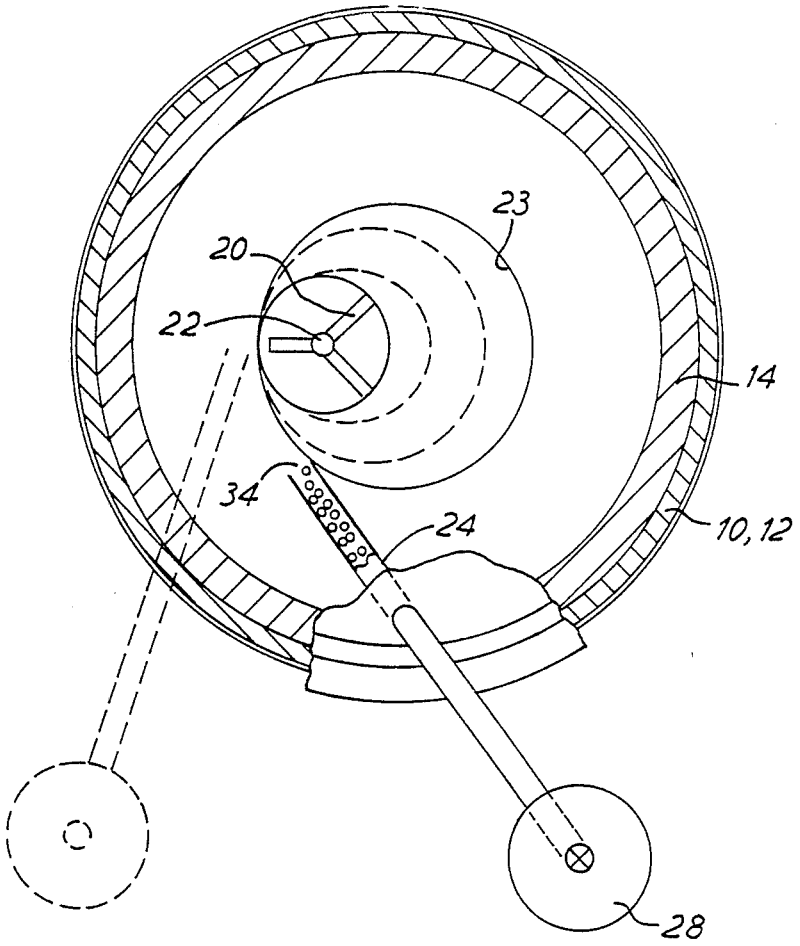

In the accompanying drawings:

FIG. 1 is a schematic sectional side elevation of a ladle equipped with means for adding a powdered alloying element to molten Al, and FIG. 2 is a corresponding plan view.

Referring to the drawings, a ladle comprises a steel shell 10, insulation 12, and a refractory lining 14 and an insulated lid 16, and contains molten Al up to a level indicated by a surface 18 a distance H above the floor of the ladle. An impeller 20 is mounted within the ladle and is rotated by means of a vertical axle 22. The impeller is mounted eccentrically so that the tips of the blades pass through the axis of the ladle, and with the blades positioned a distance $h_1$ above the floor of the ladle. Rotation of the impeller creates a vortex 23 in the surface of the molten Al. An injection lance 24 is supplied with powdered alloying element 26 from a hopper 28 with low velocity inert carrier gas (Ar, $N_2$) from pipes 30 and 32. The lance extends into the molten Al at an angle of 5° to 45° to the vertical. The tip 34 of the lance is a height $h_o$ above the floor of the ladle. In plan view (FIG. 2) the lance extends approximately tangentially to the circles formed by the impeller and the vortex.

The arrangement shown is suitable for feeding high-melting alloying elements that dissolve slowly in molten Al. For this purpose, the ration $h_1/H$ should be smaller than 0.2, the ratio $h_o/h_1$ should be in the range 1.0–3.0, the carrier gas flow rate should be small and at low velocity, and the impeller speed should be 100–250 RPM.

EXAMPLE 1

Production of AA-3003 with aluminium ladle metallurgy.

At this test location, potroom metal is delivered to a DC casting facility equipped with 50 t capacity furnaces. Molten aluminium is transported in crucibles having an average metal content of 5.7 t and a H/D ratio of 0.47. In normal practice, a furnace remains on a given alloy production for some time. In addition, a heel of alloy is maintained in the furnace from cast to cast for productivity and quality purposes. During the test period a heel of about 18 t remained after casting out of the 50 t furnace. Table 2 gives the alloy composition of AA-3003 and the necessary alloy additions to prepare a full 50 t batch from an 18 t heel of AA-3003 with primary aluminium from potrooms.

| Alloy | % of ladles to be alloyed | Alloy per charge ladle (kg) | Ladle to alloy concentration ratio | Analysis of "master alloy" delivered to furnace from process | | | | | |
|---|---|---|---|---|---|---|---|---|---|
| | | | | Cu | Fe | Mg | Mn | Si | Cr |
| AA-1100 | 1 over 8 | 250 kg | 8:1 | 0.6% | 3.7% | — | — | 0.8% | — |
| AA-3003 | 2 over 8 | 367 kg | 4:1 | 0.28 | 1.9% | — | 4.02% | 0.63% | — |
| AA-3004B | 2 over 8 | 560 kg | 4:1 | 0.57% | 1.22% | 3.78% | 4.0% | 0.54% | — |
| AA-5052 | 3 over 8 | 380 kg | 2.67:1 | — | 0.37% | 6.2% | — | — | 0.5% |
| AA-5182 | 4 over 8 | 500 kg | 2:1 | — | 0.27% | 8.18% | 0.64 | — | — |

The furnace charge (about 32 t) could then be completed with transfer of 5 potroom crucibles plus 3 tons of solid returns. We also decided to add the whole of the alloying elements into two of the five crucibles in equal quantities. Given the exothermic dissolution of Mn and Fe and because of the absence of Mg, the alloying and refining process could be performed directly in the transport crucible (not insulated). All 5 crucibles were treated with $AlF_3$ additions to remove alkali and alkaline-earth contaminants.

of fluxing in furnaces is possible. Upon charge completion, Li, Na and Ca showed less than 2 ppm. The application of this process therefore results in important reduction or elimination of ineffective furnace operations and substantial increase in productivity of the casting centre.

EXAMPLE 2

In a second series of tests, the methods and effectiveness of Mg additions in ladles were established. At this

TABLE 3

Example 1 production of AA-3003

| Crucible No. | Additions (Kg) Mn | Fe | Si | Cu | | Alloying Additions Fe—Mn Start | Fe—Mn End | Cu—Si End of Process | | Dissolution Time (min) Mn | Fe | Si | Cu |
|---|---|---|---|---|---|---|---|---|---|---|---|---|---|
| 1 | 170 | 75 | 30 | 12.5 | Process Time[1] (min) | 1.0 min | 3.5 min | 6 min | 14 min | 8 min | 10 min | 4 min | 5 min |
| | | — | | | Metal Temperature (°C.) | 808° C. | 820° C. | 834° C. | 824° C. | 8 min | 7 min | 3 min | 5 min |
| 2 | 170 | 75 | 30 | 12.5 | Process Time (min) | 1.0 min | 3.5 | 7 min | 13 min | | | | |
| | | — | | | Metal Temperature (°C.) | 821° C. | 833° C. | 843° C. | 832° C. | | | | |

| Crucible No. | Additions (Kg) Mn | Fe | Si | Cu | Metal Composition[2] Mn | Fe | Si | Cu | Concentration Ratio |
|---|---|---|---|---|---|---|---|---|---|
| 1 | 170 | 75 | 30 | 12.5 | 2.7% | 1.33% | 0.51% | 0.23% | 2.5:1 |
| 2 | 170 | 75 | 30 | 12.5 | 2.7% | 1.33% | 0.51% | 0.23% | 2.5:1 |

[1]From $AlF_3$ addition at time T = 0 min.
[2]Analyses by OES

The alloying and refining process is summarized in Table 3. A total of 287.5 Kg of alloying additions were made to each of the two process crucibles. Additions of Fe and Mn were made early in the process followed by Cu and Si while continuously stirring the melt with a rotation impeller of the type described in EPA No. 65854. Mn and Fe in powder form (approximately 85–90% −35+325 mesh) were injected under the surface of the melt using the method described in FIG. 1. Si and Cu (chunks 10 cm×down and bar slice 20 Kg respectively) were dumped into the ladle at the 6–7 min. mark. The full alloying process was completed within 14 min. for dissolution times of less than 10 min. for the various elements. Alloying of AA-3003 in ladles is also characterized by a strong exothermic dissolution resulting in a net process temperature increase of more than 10° C. With the aluminium ladle metallurgy process, a full furnace charge can be alloyed and refined within the normal charging time. Three furnace batches of AA-3003 were produced according to Example 1. Ladle and furnace analysis proved 100% recoveries on all elements, furnaces batches being on specifications upon charge completion and homogenization. Since alloying and refining in ladle is also conveniently performed in conjunction with removal of alkali and alkaline earth elements in crucibles, reduction or elimination test location, potroom crucibles carry an average of 7000 Kg of metal. These are slightly insulated and present a metal ratio H/D of about 0.74. In order to effectively remove alkali elements in the presence of Mg as discussed above, primary metal from the potroom was first transferred into a designated process ladel. Metal transfer was accomplished by direct pouring from crucible to ladle which was facilitated by the crucible teapot design. We estimated the bath content in the process ladle at less than 2 Kg/ton of Al. Four tests, No. 1 to No. 4, have been made where Mg varied from 2.5 to 4.25%. Mg was added in the form of 10 Kg ingots fed onto the surface of the melt. Alloying additions were preceeded by an $AlF_3$ addition for alkali removal (Na, Ca) in the ladle during the first 6–8 min. of process time. Upon Mg additions, the speed of the rotation impeller was reduced to less than 100 RPM (vs 150 RPM) in order to achieve non-vortex conditions. Test conditions and results are summarized in Table 4. Alloying additions between 180 Kg and 320 Kg per ladle were made at a rate of about 100 Kg/min. The dissolution of Mg was very rapid and was completed in just about 4 min. Analysis by optical emission spectrography showed recoveries to be close to 98 to 100%. When compared to alloying with Mg in furnaces (≃90% rec.) this high recovery in ladles translates into:

(a) savings in raw material for alloying (b) improvement in quality of the products.

Metal cleanliness measurements (filtration and metallographic examination technique) showed approximately a ten fold improvement over furnace practices.

TABLE 2

| Alloying requirements for AA-3003 | Mn | Fe | Si | Cu | Mg |
|---|---|---|---|---|---|
| AA-3003 spec (%) | 1.08% | 0.61% | 0.22% | 0.075% | |
| Alloying additions (Kg) | 340 Kg | 150 Kg | 60 Kg | 25 Kg | — |

Results of samples taken in ladles after processing showed inclusions at an average rate of 0.58 $mm^2/Kg$, 85% of which were small aluminium carbides. On the other hand furnace samples taken after alloying can contain inclusions varying from 2 to 10 $mm^2/Kg$ with a much higher proportion 70–80%) of detrimental MgO and $MgAl_2O_4$. Finally, it was demonstrated that low (<5 ppm) residual Na can be attained even at high Mg content by limiting cell electrolyte by means of metal transfer from potroom crucible to process ladle and by establishing non-vortex conditions. Indeed, when a vortex was created as in test No. 5 at 135 RPM, the sodium content quickly rose up to 30 ppm.

EXAMPLE 3

Production of AA-3004 (can body)

The beverage container represents today one of the most critical aluminium products particularly in terms of metal quality and metal cleanliness. This test was designed to demonstrate that the invention can be applied to critical alloys with considerable gains in both productivity of the casting centre and the quality of the product. Tests described in this example were carried out at the same location as Example 1 i.e. with 5.7 t crucibles feeding 50 t cap furnaces with primary Al from potrooms. As in Example 2, the alloying process was performed in a designated process ladle. This ladle has previously been insulated and it was preheated before metal transfer in order to minimize heat losses. Three sucessive 50 t batches were produced in a given furnace. In this case a heel of about 8–9 tons remained in the furnace after casts. The remaining charge was made of up almost entirely of primary aluminium from potrooms. Table 5 gives nominal composition of AA-3004 and typical amounts of alloying additions to the batch 50 t furnace.

TABLE 5

| Alloying requirement for AA-3004 | Mn | Fe | Cu | Si | Mg |
|---|---|---|---|---|---|
| AA-3004 Spec (%) | 1.1% | 0.44% | 0.16% | 0.20% | 1.05% |
| Alloying Additions (Kg) | 464 Kg | 100 Kg | 66 Kg | 58 Kg | 560 Kg |

From a heel of 8–9 tons of AA-3004, seven crucibles were required to fill the furnace. Of these 7 crucibles, only two were transferred into the said process ladle and alloyed (50/50), the other five were not transferred and unalloyed prior to charging into the furnace.

All crucibles and ladles were treated with an addition of $AlF_3$ for the removal of alkali and alkaline-earth contaminants. Table 6 characterizes the alloying and refining process in the ladle.

TABLE 6

Production of AA-3004
Typical ladle process (2 alloyed ladles over charge of 7)

| Additions Type | Quantity (Kg) | Process Time (min.) Start | Process Time (min.) Finish | Metal Temperature (°C.) Start | Metal Temperature (°C.) Finish | Impeller RPM |
|---|---|---|---|---|---|---|
| $AlF_3$ | 10 Kg | 0 | 1 | 808 | 804 | 130–140 |
| Mn | 234 Kg | 2 | 5.3 | 802 | 796 | 130– |
| Fe | 50 Kg | | | | | |
| Cu | 33 Kg | 8.5 | 9.5 | 828 | 830 | 130–140 |
| Si | 29 Kg | | | | | |
| Mg | 280 Kg | 11 | 13.5 | 826 | 801 | 70–90 |
| End of Test | | | 17 | | 790° | |

Table 7 provides further process information.

TABLE 7

| Element | Mn | Fe | Cu | Si | Mg |
|---|---|---|---|---|---|
| Addition (Kg) | 234 | 50 | 33 | 29 | 280 |
| Target (%) in ladle | 3.7 | 0.90 | 0.52 | 0.51 | 4.44 |
| Dissolution time (min.) | 9 | 9 | 6 | 5 | 5 |

A final analysis of metal in the process ladles showed Na and Ca concentrations of 4 ppm and 3 ppm respectively.

As in the first example, the sequence of additions was (1) $AlF^3$, (2) Mn and Fe, (3) Cu and Si and finally (4) Mg for which non-vortex conditions were established. Stirring in the ladle was again provided by an impeller of the type described in EPA 65854 following speed and positioning requirements of the present method for optimized alloying. A total of about 625 Kg of alloying elements were added to each of the process ladles during the test period (2 ladles/furnace—3 furnaces in total).

Alloying elements used for AA-3004 production were of the same form and characteristics as the ones described in Examples 1 and 2. Process time for alloyed ladles varied from 16 to 20 min. It could be further shortened down to less than 15 min. by proper automation and simultaneous alloy additions. Dissolution times were again very rapid for all elements (less than 9 min.). The ladle alloying process also proved very rapid for all elements (less than 9 min.). The ladle alloying process also proved very energy efficient. Despite the large quantities added (especially) Mg, the total process suffered only marginal temperature losses of about 15° to 20° C. on a fraction only of the melt charge. This aspect alone of ladle metallurgy can represent substantial saving over actual furnace alloying practices.

Upon charge completion and melt homogenization, all three furnace charges were at nominal composition for this alloy. Since the process of alloying in the ladle did not delay the charging time, the alloy preparation time could be reduced by about 30 to 60 minutes. In addition, alkali contaminants (Li, Na, Ca) were already low (<4 ppm) after charging. Metal cleanliness also is further improved over furnace practice, in particular, since a much smaller fraction of Mg is oxidized into $MgO\text{-}MgAl_2O_4$ during the alloying process. As discussed previously, these advantages can be used to shorten the alloy preparation steps (fluxing-settling) and/or to improve the quality of cast ingots. In this particular three (3) batch test, fluxing and settling in furnace were maintained. Inclusion counts of the feed metal from furnaces supplied by ladle metallurgy were half those found with conventional furnace practices.

We claim:

1. A method of making a cast ingot of aluminium alloyed with at least one alloying component by the steps of making molten aluminium in a production vessel, passing said aluminium from said production vessel to a treatment station, adding and dissolving said alloying component in particulate form in said aluminium in said station, passing said aluminium from said station to a casting vessel, and casting said ingot from said casting vessel, wherein said treatment station comprises one or more open topped unheated ladles and the contents of said ladles are mixed in said casting vessel.

2. A method as claimed in claim 1, wherein all the alloying components are added to and dissolved in the molten metal in a ladle.

3. A method as claimed in claim 1, wherein the production vessel is an electrolytic reduction cell.

4. A method as claimed in claim 3, wherein molten metal is passed from the cell to a potroom crucible and thence to the treatment station.

5. A method as claimed in claim 1, wherein said treatment station comprises one open topped unheated ladle used two or more times to fill said casting vessel with the required amount of alloyed aluminium.

6. A method as claimed in claim 1, wherein the treatment station comprises several open topped unheated ladles, the contents of which are mixed in the casting vessel.

7. A method as claimed in claim 6, wherein the at least one alloying component is added to and dissolved in the molten metal in at least one ladle but not in all of them.

8. A method as claimed in claim 7, wherein all the alloying components are added to and dissolved in the molten metal in at least one ladle but not in all of them.

9. A method as claimed in claim 1, wherein at least one alloying component, selected from Mn, Fe, Cr, Ni, Cu, Mg, Zn and Si, is added as a powder by subsurface injection using a carrier gas into a stirred body of the molten metal in a ladle.

10. A method as claimed in claim 9, wherein a major part of the metal powder has a particle size in the range 44 microns to 2 mm.

11. A method as claimed in claim 9, wherein the body of molten metal in a ladle is stirred by means of an impeller operated at such a speed as to create a vortex at the molten metal surface.

12. A method as claimed in claim 1, wherein at least one alloying component, selected from Cu and Si, is added in massive form to a stirred body of the molten metal in a ladle.

13. A method as claimed in claim 1, wherein the alloying component Mg is added to a body of the molten metal in a ladle which is stirred at such a speed as not to create any significant vortex at the molten metal surface.

14. A method as claimed in claim 13 wherein, prior to the Mg addition, $AlF_3$ is added to the stirred body of the molten metal in the treatment vessel in an amount to reduce Na, Ca and Li levels each to below 5 ppm.

15. A method as claimed in claim 9, wherein two or more of the following additions are made in the order given to the stirred body of molten metal in a ladle:

(i) $AlF_3$ to reduce content of Na, Ca and Li;

(ii) One or more of Mn, Fe, Cr, Ni, Cu, Zn and Si in powder form;

(iii) One or more of Zn, Cu and Si in massive form;

(iv) Mg.

* * * * *